US005277555A

United States Patent [19]

Robinson

[11] Patent Number: 5,277,555

[45] Date of Patent: Jan. 11, 1994

[54] FLUID ACTIVATED DOUBLE DIAPHRAGM PUMP

[75] Inventor: Ronald L. Robinson, 9971 State Rte. 82, Windham, Ohio 44288

[73] Assignee: Ronald L. Robinson, Windham, Ohio

[21] Appl. No.: 999,314

[22] Filed: Dec. 31, 1992

[51] Int. Cl.[5] ..... F04B 43/06

[52] U.S. Cl. ..... 417/393; 137/625.37

[58] Field of Search ..... 417/393; 137/625.37, 137/625.67; 251/900

[56] References Cited

U.S. PATENT DOCUMENTS

| | | | |
|---|---|---|---|
| 3,791,768 | 2/1974 | Wanner | 417/393 |
| 4,104,008 | 8/1978 | Hoffmann et al. | 417/397 |
| 4,247,264 | 1/1981 | Wilden | 417/393 |
| 4,478,560 | 10/1984 | Rupp | 417/393 |
| 4,535,821 | 8/1985 | Anderson | 137/625.37 X |
| 4,548,551 | 10/1985 | Ruttenberg et al. | 417/393 |
| 4,572,238 | 2/1986 | Stenlund | 137/625.37 X |
| 4,854,832 | 8/1989 | Gardner et al. | 417/393 |

FOREIGN PATENT DOCUMENTS

| | | | |
|---|---|---|---|
| 7612676-2 | 8/1979 | Sweden | 137/625.37 |

*Primary Examiner*—Richard E. Gluck
*Attorney, Agent, or Firm*—Reese Taylor

[57] ABSTRACT

An improved pilot valve construction for use in a fluid and mechanically actuated double diaphragm pump which includes a housing, first and second axially spaced fluid pressure chambers, first and second flexible diaphragms disposed in the pressure chambers and mechanically interconnected for simultaneous reciprocal movement and each defining a flexible wall of an adjacent pumping chamber and a pilot valve projecting axially into the pressure chambers and slidable axially in response to engagement by one of the diaphragms and wherein the pilot valve is provided with one or more axially extending grooves in its peripheral surface. The pilot valve may also be provided with a radially extending projection in its peripheral surface.

2 Claims, 2 Drawing Sheets

FLUID ACTIVATED DOUBLE DIAPHRAGM PUMP

BACKGROUND OF THE INVENTION

This invention relates in general to double diaphragm fluid actuated pumps and relates in particular to an improved pilot valve means therefor.

DESCRIPTION OF THE PRIOR ART

It is known in the prior art to transfer viscous liquids by the use of double diaphragm pumps. Such pumps typically comprise a housing which includes a pair of pumping chambers disposed in opposed relationship and capable of being connected to fluid inlet and outlet lines, each pumping chamber being associated with pressure chambers separated from their associated pumping chambers by flexible diaphragms. Various valve means are usually carried by the pump housing to transfer pressure from one side to the other during operation and the present invention involves an improvement to said valve means as will be explained more completely hereinafter.

In typical operation of pumps of this general type, as one pressure chamber is pressurized, its associated diaphragm is flexed to compress fluid in the associated pumping chamber. The fluid is thus forced from the pumping chamber to the associated outlet line. Simultaneously, the opposed diaphragm associated with the other pumping chamber is flexed in the opposite direction so as to draw fluid into the second pumping chamber from its associated inlet line.

These pumps thus operate by reciprocating the diaphragms, which are interconnected so as to move in unison, to alternately fill and evacuate the pumping chambers and thus draw the liquid from one source and transfer it to another.

Examples of typical pumps known to this art can be seen in Wanner U.S. Pat. No. 3,791,768; Hoffman U.S. Pat. No. 4,104,008; Wilden U.S. Pat. No. 4,247,264; Rupp U.S. Pat. No. 4,478,560; Ruttenberg U.S. Pat. No. 4,548,551; and Gardner U.S. Pat. No. 4,854,832.

For purposes of the present invention, the aforementioned Gardner U.S. Pat. No. 4,854,832 is perhaps the most relevant. That patent discloses a combined mechanical shifting mechanism and pilot valve construction designed to control the cycling of the pump. The mechanical cycling or shifting mechanism is positioned between pressure chambers and extends axially into one or the other pressure chamber. The shifting mechanism moves axially in response to engagement by one of the pump diaphragms. Upon engagement by a diaphragm, the mechanical shift opens certain pressure fluid passageways to a pneumatic pilot valve which controls fluid flow to the pressure chambers. The stated object is to provide a positive pilot signal through the entire stroke or cycle of the diaphragm pump. The mechanical shifting mechanism is not connected directly to a diaphragm or to the connecting rod which connects the diaphragm.

As pointed out in the Gardner patent, when such pumps are operated at a very slow cycle speed, or are pumping very heavy or viscous material, the overtravel of the diaphragm is reduced and the duration of the pilot or shift signal is also shortened. The result may be only partial shifting of the pilot valve or stopping of the pilot valve in the center position, thereby stalling the pump, and the Gardner patent discloses a proposed means for resolving that problem.

That solution resides in the provision of an axially shiftable, mechanical pilot member or shift rod in combination with a pneumatically operated actuator. The pilot member is a generally cylindrical rod projecting through the pump housing and into the pressure chambers and is less than the length of the shaft which extends between and interconnects the diaphragms. This member includes a reduced diameter, annular groove at approximately its midpoint and slides in a cylindrical passage through the housing along a series of O-rings. In this fashion, chambers formed intermediate the O-rings are sealed and separate from one another, and this arrangement is intended to avoid the potential of stalling at slow speeds and during intermittent operation.

One difficulty which has been observed with this design is that, as the pilot member shifts axially, there is a tendency for one of the O-rings to drop into the annular groove and significant force is required to force it out of the groove as the pilot member continues its travel. Under the low speed, low pressure or intermittent operations scenarios previously referred to, enough force may not be generated, thus causing the pump to stall or hesitate or rapidly half-stroke.

It is believed, therefore, that a still further improvement can be made in which the pilot member or shift rod can be further modified to still further enhance the continuous, uninterrupted operation of the pump by redesigning the pilot member.

SUMMARY OF THE INVENTION

It is, accordingly, a principal object of this invention to provide an improved, fluid activated double diaphragm pump capable of continuous reciprocating action in pumping viscous fluid with the elimination or minimization of any tendency of stalling, particularly at low operating speeds and during intermittent operation.

In accordance with that principal object, it has been found that, if the mechanical pilot member can be provided with, instead of a single annular groove, a series of elongate axially extending grooves about the periphery, the force required to move the pilot member can be significantly reduced.

In accordance with that principal object, it has also been found that the provision of a sharp radially extending annular projection on the body of the pilot member for engagement with and cooperation with the O-rings will further assist in overcoming the O-ring resistance. Such construction substantially eliminates the danger of stalling or hesitation at the end of the stroke.

Accordingly, production of such an improved pump becomes the principal object of this invention with other objects thereof becoming more apparent upon a reading of the following brief specification considered and interpreted in view of the drawings.

BRIEF DESCRIPTION OF THE PREFERRED EMBODIMENTS

Figure 1:
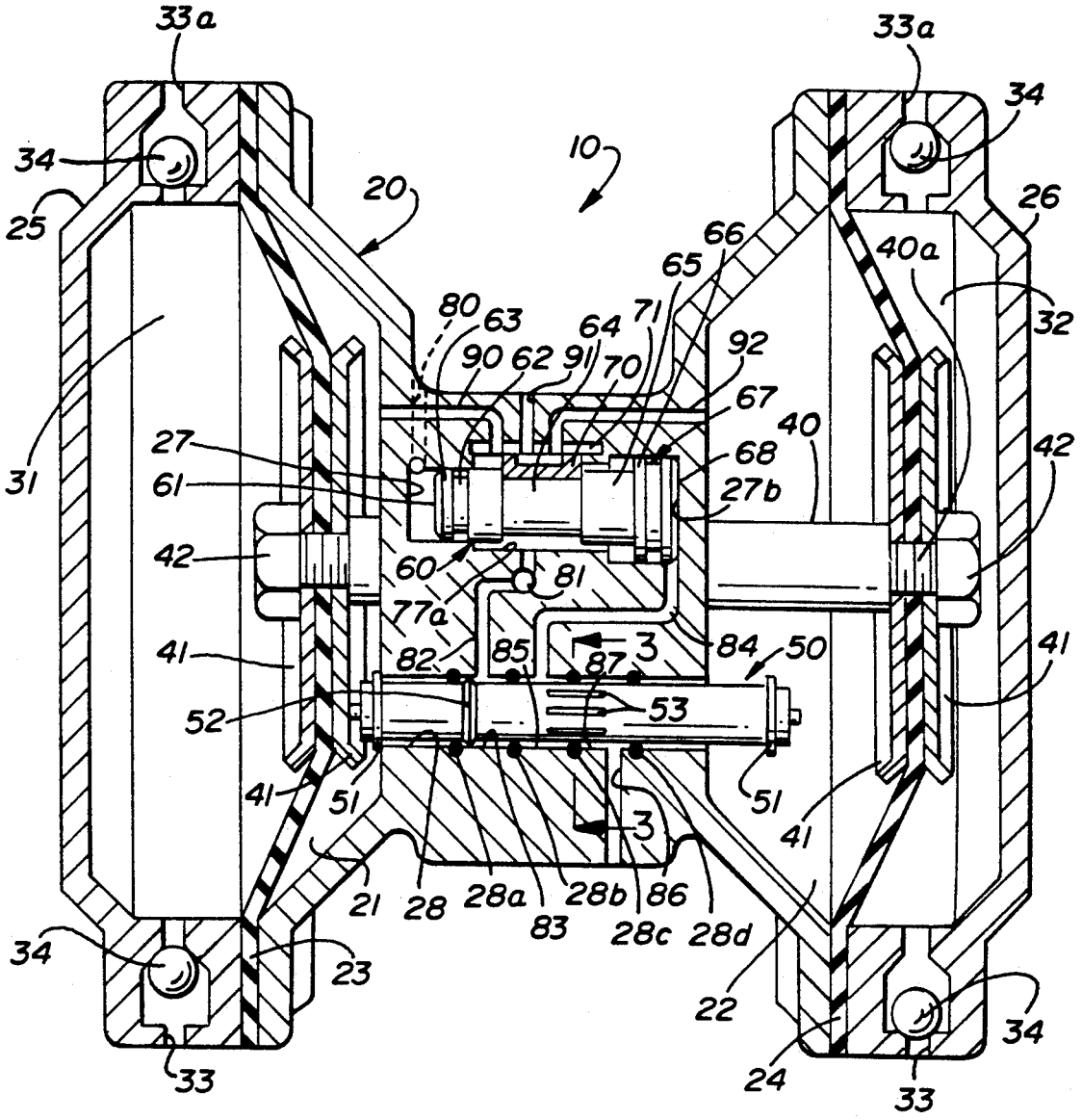
FIG. 1 is a schematic cross-sectional view of the improved valve of the present invention in one pumping position.

The drawing figures herein will be described in detail, and reference is also had to Gardner U.S. Pat. No. 4,854,832 for perhaps a more detailed description of the basic operation of the pump in question.

With that in mind, and referring to FIG. 1 of the drawings, it will be noted that the pump, generally indicated by the numeral 10, includes a main body or housing 20 which may be of multi-part construction and which has an interior cavity or first pressure chamber 21 and a second opposed interior cavity or second pressure chamber 22. The pressure chambers 21 and 22 are closed off by first and second flexible diaphragms 23 and 24, respectively.

The flexible diaphragms 23 and 24 are held in place by first and second closure members 25 and 26, respectively, which can be secured to the housing in known fashion. The effect of these assembled components is to create a first pumping chamber 31 between the first diaphragm 23 and first closure member 25 and a second pumping chamber 32 between the second diaphragm 24 and the second closure member 26.

It will also be noted that the first and second closure members 25 and 26 are provided with inlet and outlet ports 33,33 and **33*a*,33*a*, respectively, and ball valves 34,34, the operation of which will be described below. It will also be understood that the ports 33,33 and 33*a*,33*a*** are adapted to be connected to inlet and outlet lines which are not shown in the drawings.

Still referring to FIG. 1 of the drawings, it will be noted that the first and second diaphragms 23 and 24 are mechanically interconnected by a connecting rod or shaft 40 and locating plates 41,41. Thus, the locating plates 41,41, in each instance, are disposed on opposed sides of the diaphragms 23 and 24 and the plates and the diaphragms have through bores through which a threaded portion **40*a* of the connecting member 40 can be passed with the entire assembly being right or vice versa of FIG. 1**, will result in movement of the shaft and the other diaphragm.

It will also be noted from FIG. 1 of the drawings that a pilot valve cavity 28 and a spool valve cavity 27 are provided in the main body 20.

Figure 2:
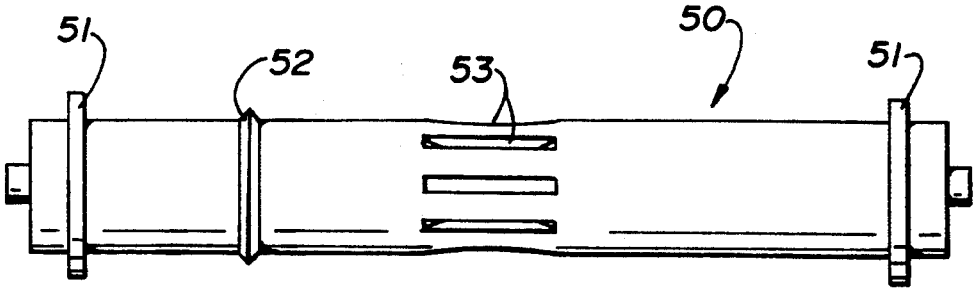
FIG. 2 is an enlarged elevational view of the improved pilot member.
Figure 3:
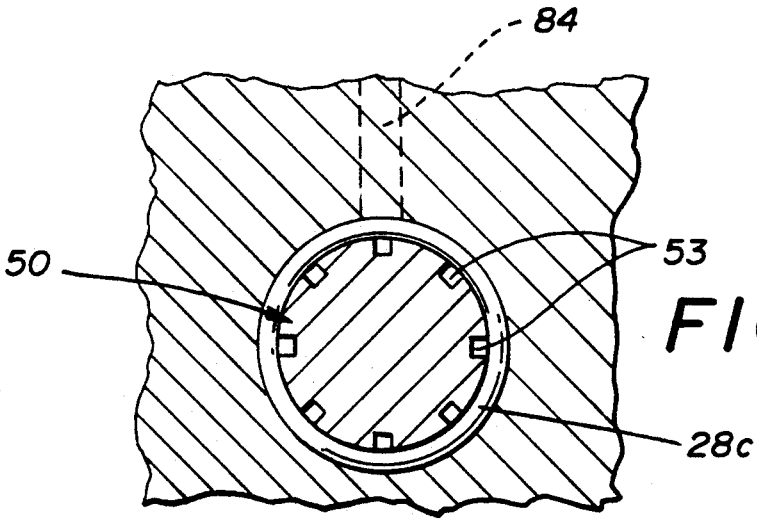
FIG. 3 is a sectional view taken along the line 3—3 of FIG. 1.
Figure 4A:
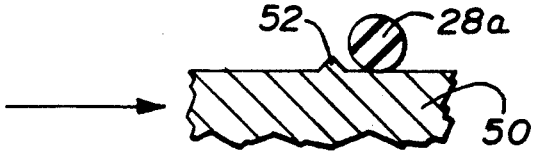
FIGS. 4*a*, 4*b*, and 4*c* show an interaction between a projection and an O-ring.
Figure 4B:
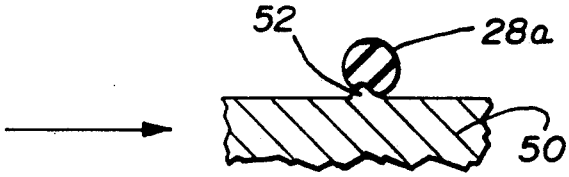
Figure 4C:
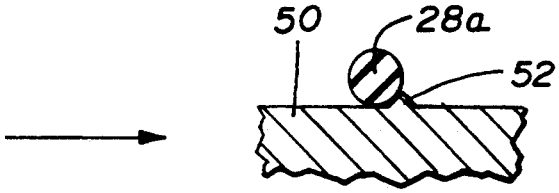

The pilot member 50 is received in the pilot valve cavity 28, and, referring to FIGS. 1 and 2 of the drawings, it will be seen that this is an elongate cylindrical member having a series of axially extending grooves 53 disposed about its periphery adjacent the midpoint thereof. Washers or snap rings 51,51 are secured at the opposed ends of the member 50 so as to prevent it from escaping entirely from the cavity 28 as it reciprocates within cavity 28. Also, a radially projecting annular spur 52 is disposed about the periphery of the member 50 for purposes which will be described. 52, which can be more clearly seen in FIGS. 2, **4*a*, 4*b*, and 4*c* of the drawings, than in FIG. 1. It will also be noted that a series of O-rings 28*a*, 28*b*, 28*c* and 28*d* are disposed about the interior of the cavity 28** and serve to seal off sections of that cavity to form various chambers as will be described in greater detail below.

An actuator or spool valve 60 is also received in a cavity in the body of the pump. This includes a generally cylindrical valve member, the body of which has a series of different diameter portions so as to provide for actuation of the pump in response to various pressure differentials as will be described. The spool valve 60 thus includes a first end portion 63 terminating in an end surface 61 and having an annular groove 62 which receives a seal in annular groove 62 and which is sized for engagement with the inner wall of the body cavity and which form chamber 27 between end surface 61 and the end of the body cavity.

The spool valve 60 also includes a reduced diameter portion 64 which receives a sliding D-valve 70. An enlarged neck portion 65 is also provided and is connected with a further expanded diameter head portion 66. An annular groove 67 is located in the head 66 and receives a seal 67 which seals on the inner surface of the enlarged portion of chamber **27*a*. The head 66 terminates in an end surface 68 and forms yet another chamber 27*b*** with the end of the body cavity.

A passage 80 interconnects the chamber 27 to the atmosphere. A fluid pressure inlet 81 connects to the chamber **27*b* and provides fluid pressure which operates the pump as will be explained. A further passage 82 leads from the fluid pressure inlet 81 to the chamber 83 formed between the O-rings 28*a* and 28*b*. A further passage 84 connects between the forward end of the chamber 27*a* and chamber 85 formed between O-rings 28*b* and 28*c*. A further passage 86 connects the chamber 87 formed between O-rings 28*c* and 28*d*** and the atmosphere.

The first pressure chamber 21 is connected by a passage 90 to the chamber **27*a* and the passage 91 connects to the atmosphere from either passage 90 or passage 92. The second pressure chamber 22 connects through the passage 92, again to the chamber 27*a*. The D-valve or slide valve 70 is constructed so as to connect only two of the passages defined through the plate 71 entering into the chamber 27*a*. Thus, the valve 70 provides connection between passages 91 and 90 or 91 and 92, depending on the position of the spool valve 60**.

In operation, air enters through the port 81, pressurizing passage 82 and also pressurizing the chamber **27*a***.

With respect to the pilot member 50, as the diaphragm 23 moves to the right, of course, the connecting member 40 also moves and the diaphragm 24 is forced to the right. It will be seen that the diaphragm 23 engages the end of the member 50 and eventually shifts it to the right as can be seen in FIG. 1 of the drawings. The detailed overall operation of the pump can be found in the aforementioned Gardner U.S. Pat. No. 4,854,832. Suffice it to say that, as the diaphragms 23 and 24 move from left to right of FIG. 1 and return, the passages 91,90 or 91,92 are selectively interconnected and the pilot member 50 is held by pressure in either chambers 21 or 22 until one or the other of plates 41,41 engages the adjacent end of member 50 and shifts in the opposite direction against the resistance of the O-rings.

The difficulty often encountered in the prior art, however, is that, in operation, and particularly in operation at low speeds or during intermittent operation, the O-rings tend to drop into the large annular recess normally provided in the middle of the pilot member 50 and significant force is required to force the O-ring out of such a full annular recess. The result is that a partial seal is created between the O-ring such as **28*c* and the wall of the recess and this would cause pressure to increase in chamber 85, thereby applying pressure to end 68 of the spool valve through passage 84. That would cause the valve to shift and, with it the D-valve 70. As soon as that takes place, pressure begins to be reduced in second pressure chamber 22, allowing diaphragm 24 to relax, causing rod 40 to begin movement to the left of FIG. 1, thereby allowing the pilot 50 to also begin moving in that direction. However, this causes pressure to be applied to end 61 which begins to move the spool back to the right to repressurize chamber 22 and recreating the partial seal referred to above. The result is a stuttering or half-stroke motion. As can be seen, this difficulty is overcome by providing the axially extending recesses 53. Much less force is required for the O-rings to be overcome as the member 50** reciprocates axially and a full stroke can be achieved even at low speeds.

Furthermore, this movement will be further facilitated because the projection 52 will also engage a selected O-ring as the member 50 moves. At first glance, this would appear to tend to stop movement before the pilot spool reaches its shifting position. However, as pressure builds in the pressure chambers 21,22, depending upon the direction of movement, it eventually becomes great enough so that the projection first compresses and then is abruptly forced over the O-ring to permit continued and complete movement of the member 50 to thus permit the pilot spool to reach its shifting position. It should be noted that the projection 52 is shown in FIG. 2 as a full annular projection, but it could also take the form of an interrupted ring presenting a series of O-ring engaging projections.

Accordingly, the stalling problem at low speeds or during intermittent operation is greatly minimized by the use of a pilot member of the type described herein.

While a full and complete description of the invention has been set forth in accordance with the dictates of the Patent Statutes, it should be understood that modifications can be resorted to without departing from the spirit hereof or the scope of the appended claims.

What is claimed is:

1. In a fluid and mechanically actuated double diaphragm pump including a housing having first and second axially spaced fluid pressure chambers, first and second flexible diaphragms disposed in the fluid pressure chambers and being mechanically interconnected for simultaneous reciprocal movement and each defining a flexible wall of an adjacent pumping chamber and a pilot valve projecting axially into the pressure chambers and slidable in an elongate cavity in the housing in response to engagement by one of the diaphragms, stop members disposed adjacent the opposed ends of the pilot valve which extend into the pressure chambers and a plurality of O-rings in the interior of the cavity, the improvement comprising: said pilot valve including an elongate cylindrical member having at least one elongate, axially extending groove disposed in its peripheral surface; and at least one radially extending O-ring engaging projection is disposed on said peripheral surface of said elongate cylindrical member.

2. The improvement of claim 1 wherein a plurality of elongate, axially extending grooves are provided in said peripheral surface of said elongate cylindrical member.

* * * * *

UNITED STATES PATENT AND TRADEMARK OFFICE

CERTIFICATE OF CORRECTION

PATENT NO. : 5,277,555

DATED : January 11, 1994

INVENTOR(S) : Ronald L. Robinson

It is certified that error appears in the above-identified patent and that said Letters Patent is hereby corrected as shown below:

In Column 3, line 56, before "52," insert ---Projection---.

Signed and Sealed this

Twenty-first Day of June, 1994

Bruce Lehman

*Attest:*

BRUCE LEHMAN

*Attesting Officer*

*Commissioner of Patents and Trademarks*